US011510303B1

(12) United States Patent
Tsai

(10) Patent No.: US 11,510,303 B1
(45) Date of Patent: Nov. 22, 2022

(54) LIGHT STRING CONTROLLING DEVICE CAPABLE OF BOOSTING POWER

(71) Applicant: Cosmo Lighting Inc., Walnut, CA (US)

(72) Inventor: Nai-Chen Tsai, New Taipei (TW)

(73) Assignee: COSMO LIGHTING INC., Walnut, CA (US)

( * ) Notice: Subject to any disclaimer, the term of this patent is extended or adjusted under 35 U.S.C. 154(b) by 0 days.

(21) Appl. No.: 17/569,709

(22) Filed: Jan. 6, 2022

(51) Int. Cl.

| | |
|---|---|
| ***H05B 47/11*** | (2020.01) |
| ***F21S 9/02*** | (2006.01) |
| ***H05B 47/175*** | (2020.01) |
| ***H05B 47/16*** | (2020.01) |
| *F21S 4/10* | (2016.01) |
| *F21V 23/00* | (2015.01) |

(52) U.S. Cl.
CPC ..... *H05B 47/175* (2020.01); *H05B 47/11* (2020.01); *H05B 47/16* (2020.01); *F21S 4/10* (2016.01); *F21S 9/02* (2013.01); *F21V 23/003* (2013.01)

(58) Field of Classification Search
CPC ..... H05B 47/10; H05B 47/11; H05B 47/16; H05B 47/175; F21S 4/10; F21S 9/02; F21V 23/003
See application file for complete search history.

(56) References Cited

U.S. PATENT DOCUMENTS

2010/0141161 A1* 6/2010 Hering ..... H05B 45/42 315/185 S

FOREIGN PATENT DOCUMENTS

CN 213906990 U * 8/2021

* cited by examiner

*Primary Examiner* — Jimmy T Vu
(74) *Attorney, Agent, or Firm* — Li & Cai Intellectual Property (USA) Office

(57) ABSTRACT

A light string controlling device capable of boosting power is provided. One or more batteries are accommodated into a control box. A control circuit controls a power converter circuit to convert power supplied by the one or more batteries according to an amount of power required for a light string to produce a desired lighting effect. A remote controller outputs a remote control signal to the control circuit to instruct the control circuit to control the light string to produce the desired lighting effect.

11 Claims, 10 Drawing Sheets

LIGHT STRING CONTROLLING DEVICE CAPABLE OF BOOSTING POWER

FIELD OF THE DISCLOSURE

The present disclosure relates to a light string, and more particularly to a light string controlling device capable of boosting power for controlling a light string.

BACKGROUND OF THE DISCLOSURE

The most common uses of light strings are for decoration and display purposes, particularly during Christmas time and other holidays, and more particularly for decoration of Christmas trees, inside and outside of commercial, industrial and residential buildings, trees and shrubbery, and the like.

The light strings provide a livelier celebratory atmosphere for festivals or holidays. Such light strings need to exhibit various lighting effects to match different moods. However, batteries received in a control box of the light string may not supply sufficient power to the light string. Under this condition, a brightness of the light string is lower than a target brightness value, such that the light string cannot exhibit a desired lighting effect.

SUMMARY OF THE DISCLOSURE

In response to the above-referenced technical inadequacies, the present disclosure provides a light string controlling device capable of boosting power. The light string controlling device includes a control box, a power supply circuit, a power converter circuit, a control circuit and a remote controller. The control box has a first accommodation space and a second accommodation space. The power supply circuit is accommodated in the first accommodation space of the control box and configured to supply power. The power converter circuit is accommodated in the second accommodation space of the control box. The power converter circuit is connected to the power supply circuit. The power converter circuit converts the power from the power supply circuit and outputs the power that is converted. The control circuit is accommodated in the second accommodation space of the control box. The control circuit is connected to the power converter circuit and a light string. The control circuit controls the power converter circuit to convert the power according to an amount of power required for the light string to produce a desired lighting effect and transmits the power from the power converter circuit to the light string. The control circuit controls the light string to produce the desired lighting effect. The remote controller is disposed outside the control box and connected to the control circuit. The remote controller is configured to output a remote control signal to the control circuit to control the control circuit.

In certain embodiments, the power converter circuit includes a boost converter circuit. The boost converter circuit is configured to boost the power from the power supply circuit.

In certain embodiments, the power supply circuit includes a battery accommodated in the first accommodation space of the control box. When the control circuit determines that an amount of the power supplied by the battery is smaller than the amount of power required for the light string to produce the desired lighting effect, the control circuit calculates a difference between the amount of the power supplied by the battery and the amount of power required for the light string.

The control circuit controls the power converter circuit to boost the power supplied by the battery according to the difference.

In certain embodiments, the power supply circuit includes a plurality of batteries accommodated in the first accommodation space of the control box. When the control circuit determines that a total amount of the power supplied by the plurality of batteries is smaller than the amount of power required for the light string to produce the desired lighting effect, the control circuit calculates a difference between the total amount of the power supplied by the plurality of batteries and the amount of power required for the light string. The control circuit controls the power converter circuit to boost the power supplied by one or more of the plurality of batteries according to the difference.

In certain embodiments, the light string controlling device further includes a mode switch component. The mode switch component is disposed on the control box and disposed adjacent to the control circuit. When each time the mode switch component is triggered, the control circuit counts a number of times that the mode switch component is triggered, and the control circuit controls the light string to enter one of a plurality of lighting modes according to the number of times that the mode switch component is triggered. The light string exhibits a plurality of lighting states respectively in the plurality of lighting modes.

In certain embodiments, the light string controlling device further includes a light sensing component. The light sensing component may be connected to the control circuit. The light sensing component is configured to sense an intensity of an ambient light to output a light sensed signal to the control circuit. The control circuit controls the light string according to the light sensed signal.

In certain embodiments, the light string controlling device further includes a power-on switch component and a power-off switch component. The power-on switch component is disposed on the remote controller. The power-off switch component is disposed on the remote controller. When the power-on switch component is turned on, the remote controller controls the control circuit to transmit the power from the power converter circuit to the light string. When the power-off switch component is turned on, the remote controller does not control the control circuit to transmit the power from the power converter circuit to the light string.

In certain embodiments, the light string controlling device further includes a plurality of time switch components. The time switch components are disposed on the remote controller. When the plurality of the time switch components are respectively turned on, the remote controller instructs the control circuit to control the light string to emit the light respectively within a plurality of preset times.

In certain embodiments, the light string controlling device further includes a mode switch component. The mode switch component is disposed on the remote controller. When each time the mode switch component is triggered, the remote controller counts a number of times that the mode switch component is triggered, and controls the light string to enter one of a plurality of lighting modes, according to the number of times that the mode switch component is triggered. The light string exhibits a plurality of lighting states respectively in the plurality of lighting modes.

In certain embodiments, the light string controlling device further includes a color changing switch component. The color changing switch component is disposed on the remote controller. When the color changing switch component is triggered, the remote controller controls the light string to change a color of the light emitted by the light string. The color of the light emitted by the light string depends on a number of times that the color changing switch component is triggered.

In certain embodiments, the light string controlling device further includes a brightness increasing component and a brightness decreasing component. The brightness increasing component is disposed on the remote controller. The brightness decreasing component is disposed on the remote controller. When each time the brightness increasing component is triggered, the remote controller instructs the control circuit to increase the power supplied to the light string. When each time the brightness decreasing component is triggered, the remote controller controls the control circuit to decrease the power supplied to the light string.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments are better understood by reference to the following description and the accompanying drawings, in which.

DETAILED DESCRIPTION OF THE EXEMPLARY EMBODIMENTS

Figure 1:
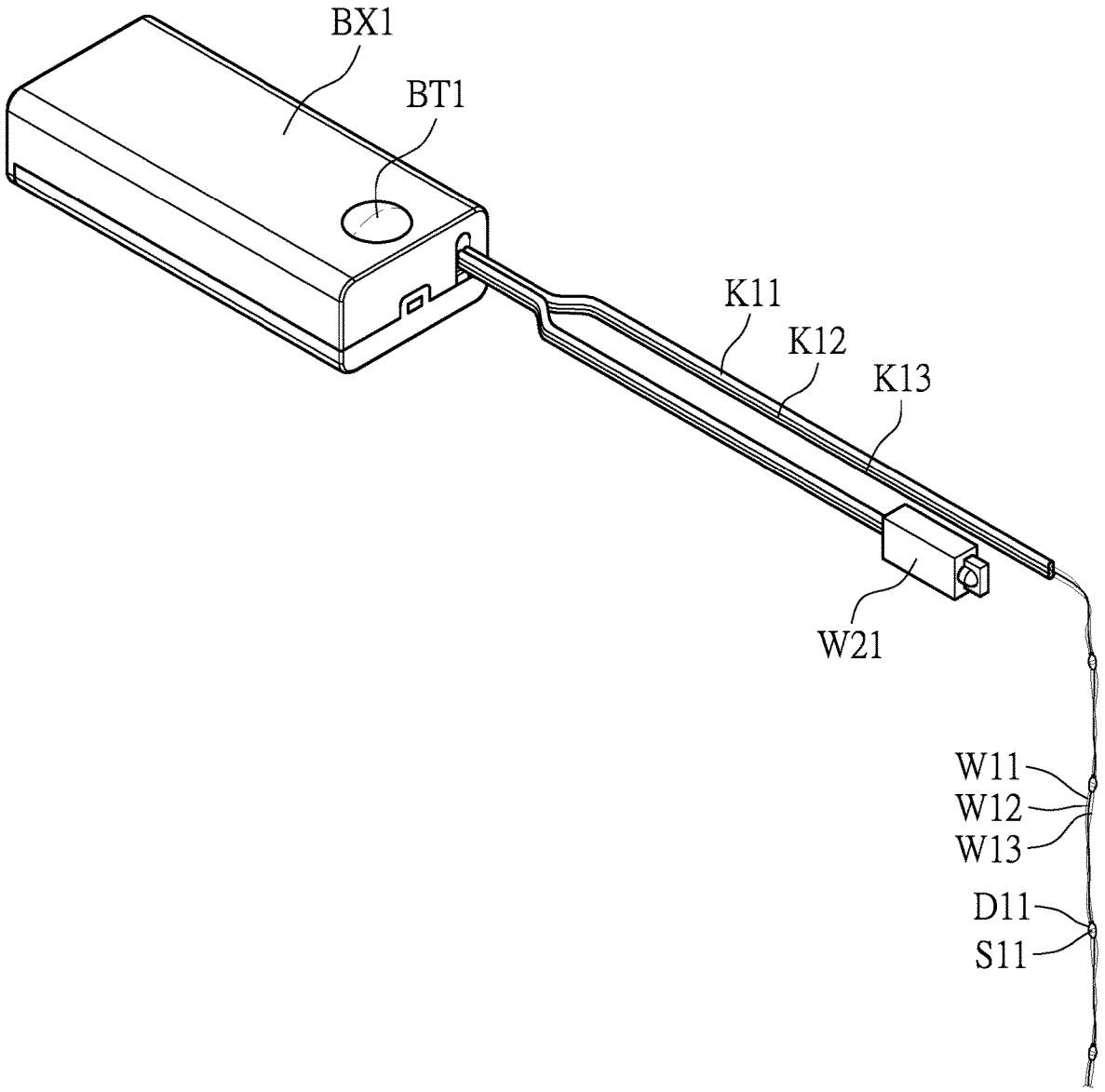
FIG. 1 is a schematic view of an assembly of a control box of a light string controlling device capable of boosting power according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
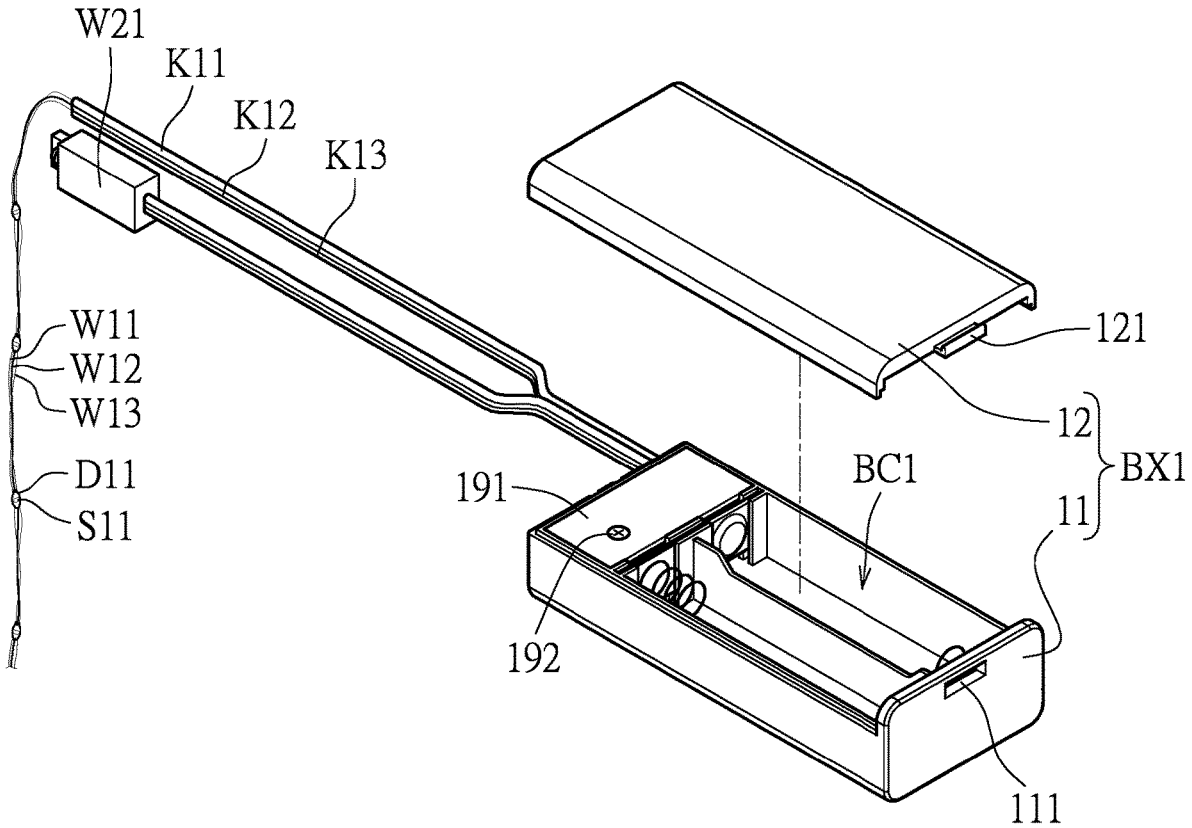
FIG. 2 is an exploded view of a control box of the light string controlling device capable of boosting power according to a first embodiment of the present disclosure.
Figure 3:
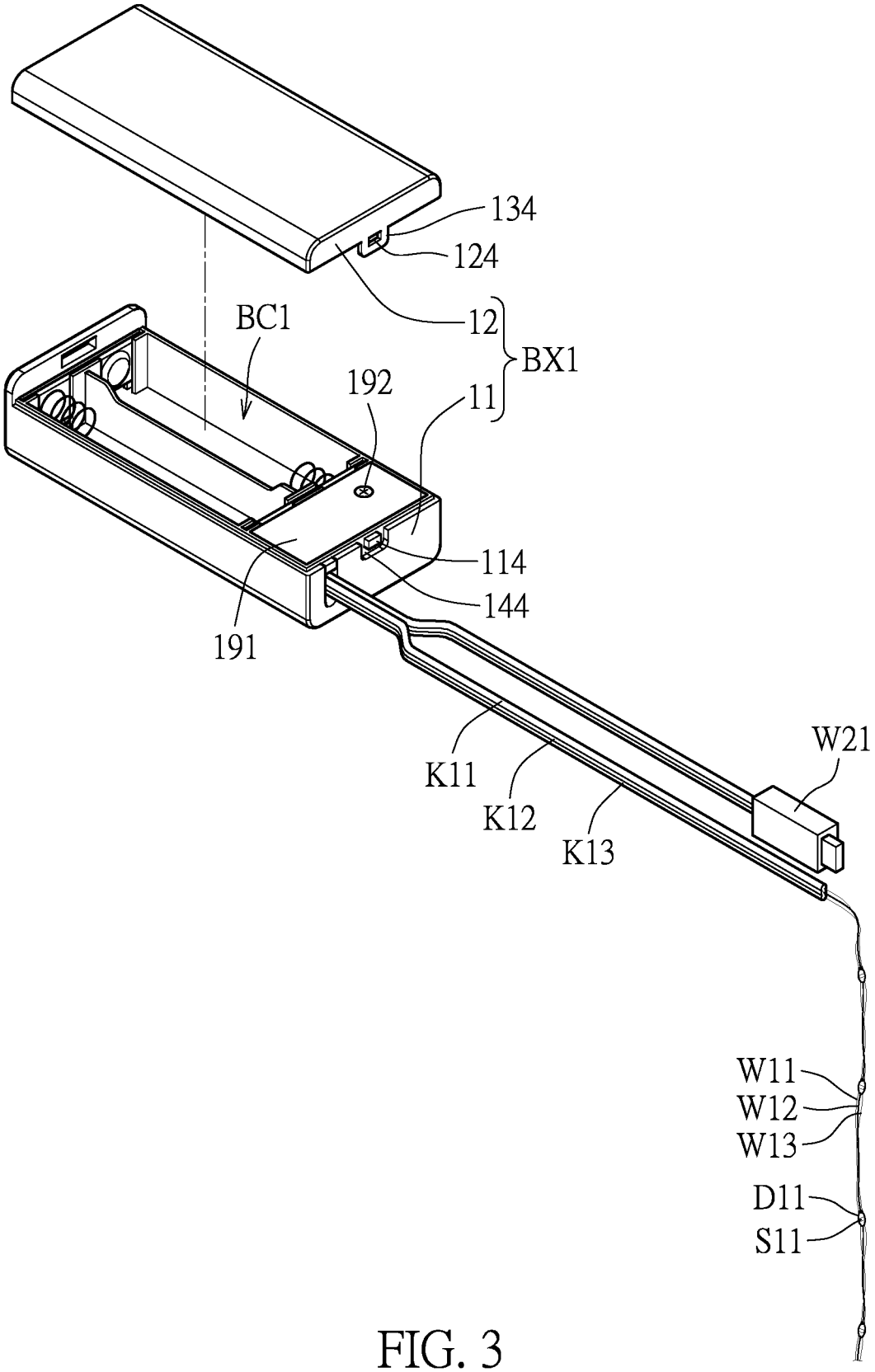
FIG. 3 is an exploded view of the control box of the light string controlling device capable of boosting power according to the first embodiment of the present disclosure.

Reference is made to FIGS. 1 to 3, which FIG. 1 is a schematic view of an assembly of a control box of a light string controlling device capable of boosting power according to a first embodiment of the present disclosure, and FIGS. 2 and 3 are exploded views of the control box of the light string controlling device capable of boosting power according to the first embodiment of the present disclosure.

The light string controlling device includes a control box BX1. A control circuit accommodated in the control box BX1 is electrically connected to a light string. The light string may include a plurality of wires W11, W12, W13 and a plurality of light-emitting elements D11. A part of each of the wires W11, W12, W13 may be wrapped by insulation elements K11, K12, W13. The light-emitting elements D11 are spaced from each other. Each of the light-emitting elements D11 may include a single chip or multiple chips and may be covered by a protecting element S11 such as a resin.

A mode switch component BT1 may be disposed on the control box BX1. When each time the mode switch component BT1 is triggered, the control circuit counts a number of times that the mode switch component BT1 is triggered, and controls the light string to enter one of a plurality of lighting modes according to the number of times that the mode switch component BT1 is triggered. The light string exhibits a plurality of lighting states respectively in the plurality of lighting modes, which are exemplified in the following.

For example, when the mode switch component BT1 is triggered once, the control circuit controls the light string to enter a first one of the plurality of lighting modes. In the first one of the plurality of lighting modes, all or some of the plurality of light-emitting elements D11 of the light string stably emit light within a preset time such as, but not limited to, four hours.

When the mode switch component BT1 is triggered twice, the control circuit controls the light string to enter a second one of the plurality of lighting modes. In the second one of the plurality of lighting modes, all or some of the plurality of light-emitting elements D11 of the light string twinkle quickly within the preset time such as, but not limited to, four hours.

When the mode switch component BT1 is triggered thrice, the control circuit controls the light string to enter a third one of the plurality of lighting modes. In the third one of the plurality of lighting modes, all or some of the plurality of light-emitting elements D11 of the light string twinkle within the preset time such as, but not limited to, four hours.

When the mode switch component BT1 is triggered four times, the control circuit controls the light string to enter a fourth one of the plurality of lighting modes. In the fourth one of the plurality of lighting modes, all or some of the plurality of light-emitting elements D11 of the light string glisten quickly within the preset time such as, but not limited to, four hours.

When the mode switch component BT1 is triggered five times, the control circuit controls the light string to enter a fifth one of the plurality of lighting modes. In the fifth one of the plurality of lighting modes, all or some of the plurality of light-emitting elements D11 of the light string glisten within the preset time such as, but not limited to, four hours.

When the mode switch component BT1 is triggered six times, the control circuit controls the light string to enter a sixth one of the plurality of lighting modes. In the sixth one of the plurality of lighting modes, all or some of the plurality of light-emitting elements D11 of the light string glisten slowly within the preset time such as, but not limited to, four hours.

When the mode switch component BT1 is triggered seven times, the control circuit controls the light string to enter a seventh one of the plurality of lighting modes. In the seventh one of the plurality of lighting modes, all or some of the plurality of light-emitting elements D11 of the light string steadily emit light, for example, in a constant manner.

After the number of times that the mode switch component BT1 is triggered reaches a number of the plurality of lighting modes, one cycle is completed. Under this condition, the control circuit clears the number of times that is counted by the control circuit.

For example, the number of the plurality of lighting modes is seven. When the mode switch component BT1 is triggered seven times, the control circuit clears the number of times that is counted by the control circuit.

When different numbers of cycles are completed, the control circuit may control the light string to emit different lights (or, in practice, the same light) in each of the lighting modes. For example, during a first cycle, the control circuit may control the light string to emit light having a first color such as a white light, or emit light having a first brightness such as a clear light. Then, when the first cycle is completed and a second cycle is being performed, the control circuit may control the light string to emit light having a second color such as a color light, or emit light having second brightness.

If necessary, the light string controlling device may further include a connection wire W21. The control circuit inside the control box BX1 may be connected to an external device through the connection wire W21. The external device may be used to control the control circuit inside the control box BX1.

The control box BX1 includes a base member and a cover member. The base member of the control box BX1 may include a base body 11 and a first base bonding part 111. The cover member of the control box BX1 may include a cover body 12 and a first cover bonding part 121. The first base bonding part 111 may penetrate through the base body 11. The first cover bonding part 121 may extend away from a first surface of the cover body 12.

The cover member of the control box BX1 may further include a second cover bonding part 134. The second cover bonding part 134 and the first cover bonding part 121 are respectively located at two opposite surfaces of the cover body 12. A hollow part 124 is located between the second cover bonding part 134 and the cover body 12.

The base member of the control box BX1 may further include a second base bonding part 144. The second base bonding part 144 may be recessed from the base body 11. A protruding part 114 may be surrounded by the second base bonding part 144.

The base body 11 of the base member of the control box BX1 may have a first accommodation space BC1 and second accommodation space.

The control circuit and a power converter circuit may be accommodated in the second accommodation space of the control box BX1. The second accommodation space of the control box BX1 may be sealed by a protection plate 191. The protection plate 191 is fixed on the base body 11 of the base member of the control box BX1 by a fixing member 192 such as a screw.

It is worth noting that, the first accommodation space BC1 of the control box BX1 may include a plurality of sub-accommodation spaces which can respectively accommodate a plurality of batteries.

For example, the control box BX1 has three sub-accommodation spaces that can accommodate three batteries, and each of the three batteries can supply a maximum voltage of 1.5V. A sum of the maximum voltages that the three batteries can supply is 4.5V. However, am amount of power required for the light string to produce a desired lighting effect may be larger than the sum the maximum voltages that the three batteries can supply such as 4.5V.

Therefore, in the embodiment, the light string controlling device includes a power converter circuit accommodated in the second accommodation space of the control box BX1. The control circuit is connected to the power converter circuit and the light string.

When a total amount of the power supplied by the plurality of batteries accommodated in the control box BX1 is smaller than the amount of power required for the light string to produce the desired lighting effect, the control circuit calculates a difference between the total amount of the power supplied by the plurality of batteries and the amount of power required for the light string, or a ratio of the amount of the power supplied by the battery to the amount of power required for the light string. Then, the control circuit controls the power converter circuit to boost the power supplied by one or more of the plurality of batteries according to the difference or the ratio. Finally, the control circuit transmits the boosted power to the light string and controls the light string to produce the desired lighting effect.

For example, the power converter circuit may include a boost converter circuit. The control circuit may control the boost converter circuit to boost the power from the power supply circuit. The control circuit may transmit the (boosted) power from the power converter circuit to the light string.

If necessary, the control circuit may control the power converter circuit to supply different amounts of power respectively within time intervals. The control circuit may gradually reduce or increase the amount of the power transmitted to the light string over time.

That is, the power converter circuit may supply a first amount of the power within a first one of the time intervals, then supply a second amount of the power within a second one of the time intervals, then supply a third amount of the power within a third one of the time intervals, and so on.

For example, a ratio of the first amount of the power to a maximum amount of the power that all of the batteries placed in the control box BX1 can supply at a same point is equal to a first preset ratio (such as 100%). A ratio of the second amount of the power to the maximum amount of the power is equal to a second preset ratio (such as 80%). A ratio of the third amount of the power to the maximum amount of the power can supply is equal to a third preset ratio (such as 50%).

Second Embodiment

Figure 4:
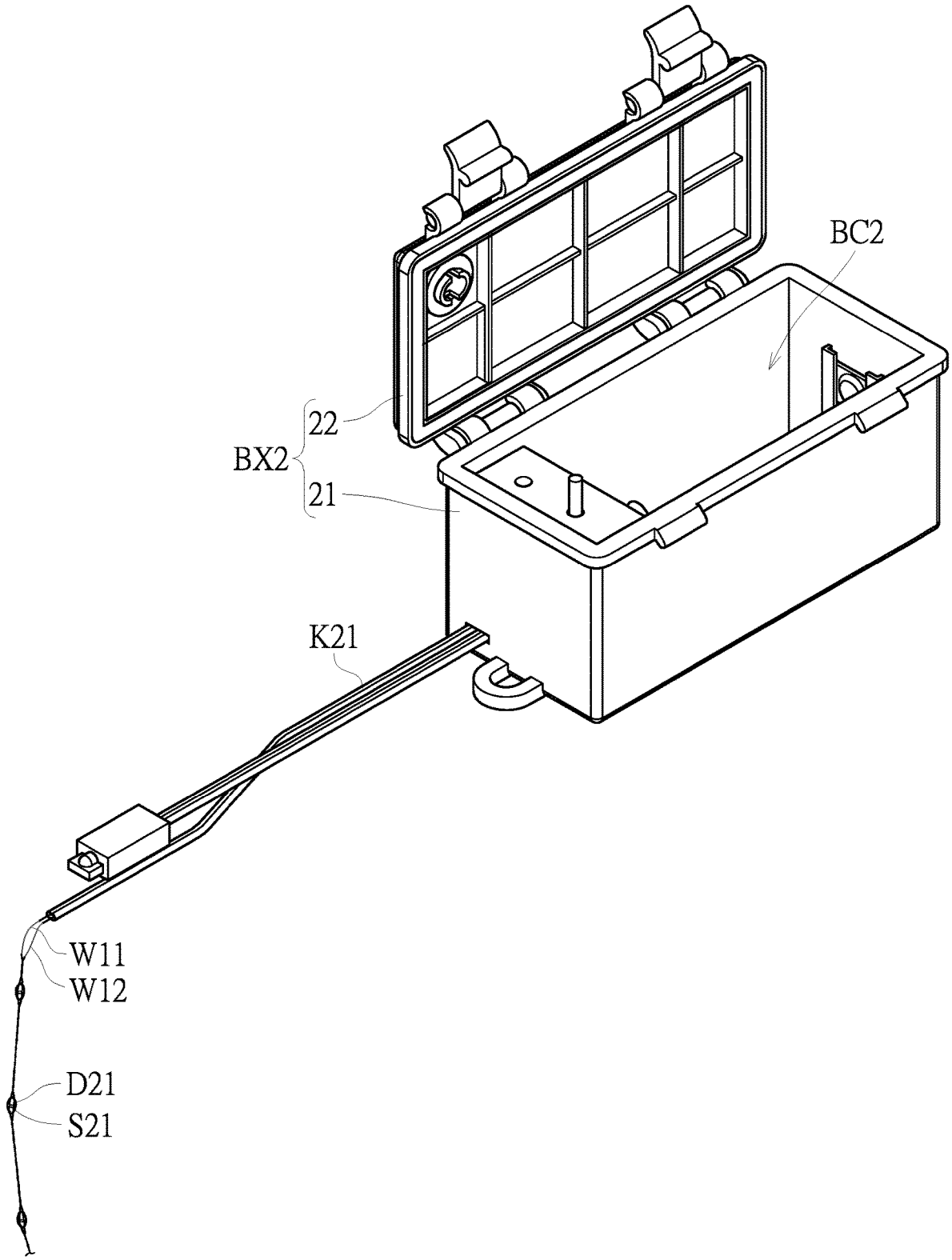
FIG. 4 is a schematic front view of a control box of a light string controlling device according to a second embodiment of the present disclosure.

Reference is made to FIG. 4, which is a schematic front view of a control box of a light string controlling device according to a second embodiment of the present disclosure.

The light string controlling device may include a control box BX2. The control box BX2 includes a base member 21 and a cover member 22. The cover member 22 is bonded to the base member 21.

The control box BX2 has a first accommodation space and a second accommodation space BC2. A power supply circuit and a control circuit are accommodated in the first accommodation space of the control box BX2.

The control circuit is electrically connected to a light string. The light string may include a plurality of light-emitting elements D21 and a plurality of wires such as the first wire W11 and the second wire W12 that may be wrapped by an insulation element K21. Each of the light-emitting elements D21 may be covered by a protecting element S21 such as a resin.

It is worth noting that, the power supply circuit may include one battery accommodated in the first accommodation space BC1 of the control box BX2. When the control circuit determines that the amount of the power supplied by the battery is smaller than the amount of power required for the light string to produce the desired lighting effect, the control circuit calculates the difference between the amount of the power supplied by the battery and the amount of power required for the light string, or a ratio of the amount of the power supplied by the battery to the amount of power required for the light string. Then, the control circuit controls the power converter circuit to boost the power supplied by the battery according to the difference or the ratio. Finally, the control circuit transmits the boosted power to the light string.

Third Embodiment

Figure 5:
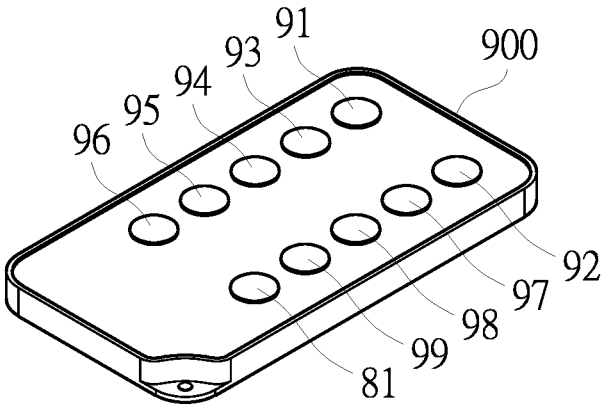
FIG. 5 is a schematic view of a remote controller of a light string controlling device capable of boosting power according to a third embodiment of the present disclosure.

Reference is made to FIG. 5, which is a schematic view of a remote controller of a light string controlling device capable of boosting power according to a third embodiment of the present disclosure.

The light string controlling device may include a remote controller 900 and one or more switch components. The switch components may be disposed on a front surface of a case of the remote controller 900 and disposed adjacent to a remote control circuit inside the case of the remote controller 900. For example, the switch components may be buttons, but the present disclosure is not limited thereto.

The remote control circuit of the remote controller 900 is disposed outside a control box and may be connected to the control circuit of the controller box such as the control box BX1 shown in FIGS. 1 to 3. The remote controller 900 is connected to the control circuit inside the control box BX1. The remote control circuit of the remote controller 900 may output a remote control signal to instruct the control circuit to control the light string and the power converter device.

For example, the switch components of the remote controller 900 may include a power-on switch component 91 and a power-off switch component 92.

When the power-on switch component 91 is turned on, the remote control circuit of the remote controller 900 controls the control circuit to transmit the power from the power converter circuit to the light string.

When the power-off switch component 92 is turned on, when the power-off switch component is turned on, the remote control circuit of the remote controller 900 does not control the control circuit to transmit the power from the power converter circuit to the light string.

As described above, the light string controlling device includes two power switch components that are the power-on switch component 91 and the power-off switch component 92, but the present disclosure is not limited thereto. In practice, the light string controlling device may only include one power switch component. When the power switch component is turned on, the remote control circuit of the remote controller 900 controls the control circuit to transmit the power from the power converter circuit to the light string. Conversely, when the power switch component is turned off, the remote control circuit of the remote controller 900 does not control the control circuit to transmit the power from the power converter circuit to the light string.

For example, the switch components of the remote controller 900 may include a mode switch component 95. When each time the mode switch component 95 is triggered, the remote control circuit of the remote controller 900 counts a number of times that the mode switch component is triggered, and controls the light string to enter one of a plurality of lighting modes, according to the number of times that the mode switch component is triggered. The light string exhibits the plurality of lighting states respectively in the plurality of lighting modes.

For example, the switch components of the remote controller 900 may include a color changing switch component 99. When each time the color changing switch component 99 is triggered, the remote control circuit of the remote controller 900 counts a number of times that the color changing switch component is triggered, and controls the light string to change a color of the light emitted by the light string. The color of the light emitted by the light string depends on the number of times that the color changing switch component is triggered.

For example, the switch components of the remote controller 900 may include a brightness increasing component 96 and a brightness decreasing component 81.

When each time the brightness increasing component 96 is triggered, the remote control circuit of the remote controller 900 instructs the control circuit to increase the power transmitted to the light string from the power converter circuit from the control circuit.

When each time the brightness decreasing component 81 is triggered, the remote control circuit of the remote controller 900 controls the control circuit to decrease the power transmitted to the light string from the power converter circuit from the control circuit.

For example, the switch components of the remote controller 900 may further include a plurality of time switch components 93, 94, 97, 98.

When the plurality of the time switch components 93, 94, 97, 98 are respectively turned on, the remote control circuit of the remote controller 900 instructs the control circuit to control the light string to emit the light respectively within a plurality of preset times.

For example, when the time switch component 93 is turned on, the remote control circuit of the remote controller 900 instructs the control circuit to control the light string to emit the light within a first one of the plurality of preset times, such as, but not limited to, 6 hrs.

When the time switch component 94 is turned on, the remote control circuit of the remote controller 900 instructs the control circuit to control the light string to emit the light within a second one of the plurality of preset times, such as, but not limited to, 8 hrs.

When the time switch component 97 is turned on, the remote control circuit of the remote controller 900 instructs the control circuit to control the light string to emit the light within a third one of the plurality of preset times, such as, but not limited to, 10 hrs.

When the time switch component 98 is turned on, the remote control circuit of the remote controller 900 instructs the control circuit to control the light string to emit the light within a fourth one of the plurality of preset times, such as, but not limited to, 24 hrs.

A number of and types of the time switch components included in the light string controlling device may be adjusted according to actual requirements, and the present disclosure is not limited thereto.

Fourth Embodiment

Figure 6:
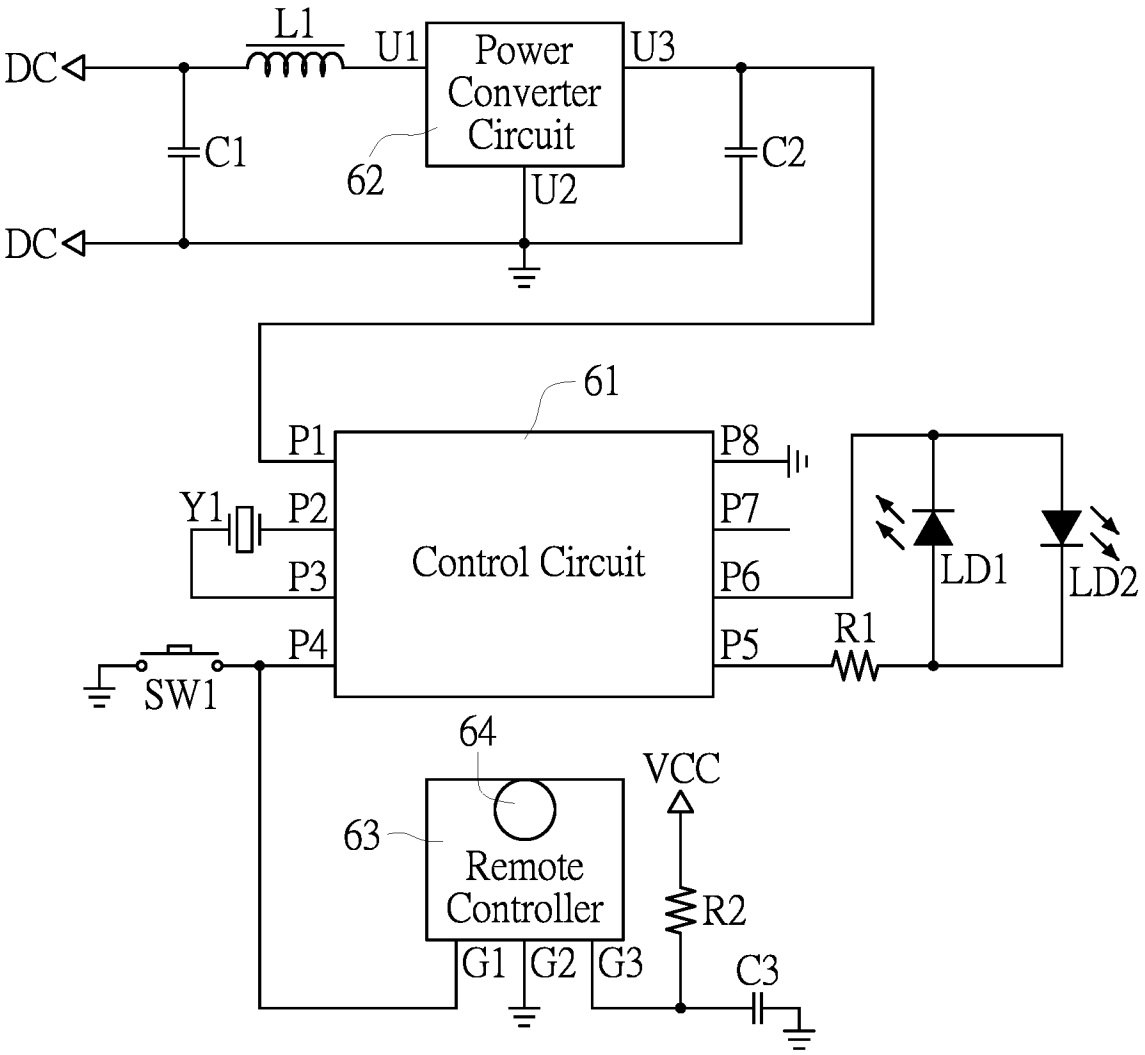
FIG. 6 is a circuit layout diagram of a light string controlling device capable of boosting power according to a fourth embodiment of the present disclosure.

Reference is made to FIG. 6, which is a circuit layout diagram of a light string controlling device capable of boosting power according to a fourth embodiment of the present disclosure.

The light string controlling device may include a control circuit 61, a power converter circuit 62 and a remote controller 63.

A first pin U1 of the power converter circuit 62 may be connected to a first terminal of an inductance coil L1. A second terminal of the inductance coil L1 may be connected to a DC power and a first terminal of a first capacitor C1. A second terminal of the first capacitor C1 may be grounded. A second pin U2 of the power converter circuit 62 may be grounded. A third pin U3 of the power converter circuit 62 may be connected to a first terminal of a second capacitor C2. A second terminal of the second capacitor C2 may be grounded.

A first pin P1 of the control circuit 61 may be connected to the third pin U3 of the power converter circuit 62. A second pin P2 of the control circuit 61 may be connected to a first terminal of an oscillator Y1. A second terminal of the oscillator Y1 may be connected to a third pin P3 of the control circuit 61. A fourth pin P4 of the control circuit 61 may be connected to a first terminal of a first switch SW1. A second terminal of the first switch SW1 may be grounded.

A fifth pin P5 of the control circuit 61 may be connected to a first terminal of a second resistor R1. A second terminal of the second resistor R1 may be connected to a second terminal such as an anode terminal of a first light-emitting component LD1 through a first wire. A first terminal such as a cathode terminal of the first light-emitting component LD1 may be connected to a sixth pin P6 of the control circuit 61 through a second wire. The sixth pin P6 of the control circuit 61 is further connected to a first terminal such as an anode terminal of a second light-emitting component LD2 through the second wire. A second terminal such as a cathode terminal of the second light-emitting component LD2 may be connected to the second terminal of the second resistor R1 through the first wire. An eighth pin P8 of the control circuit 61 may be grounded.

A first pin G1 of the remote controller 63 may be connected to the fourth pin P4 of the control circuit 61. A second pin G2 of the remote controller 63 may be grounded. A third pin G3 of the remote controller 63 may be connected to a first terminal of a third capacitor C3 and a first terminal of a first resistor R2. A second terminal of the third capacitor C3 may be grounded. A second terminal of the first resistor R2 may be coupled to a common voltage VCC. A switch component 64 (which may be the same as or similar to the above-mentioned mode switch component 95) is disposed on the remote controller 63.

Fifth Embodiment

Figure 7:
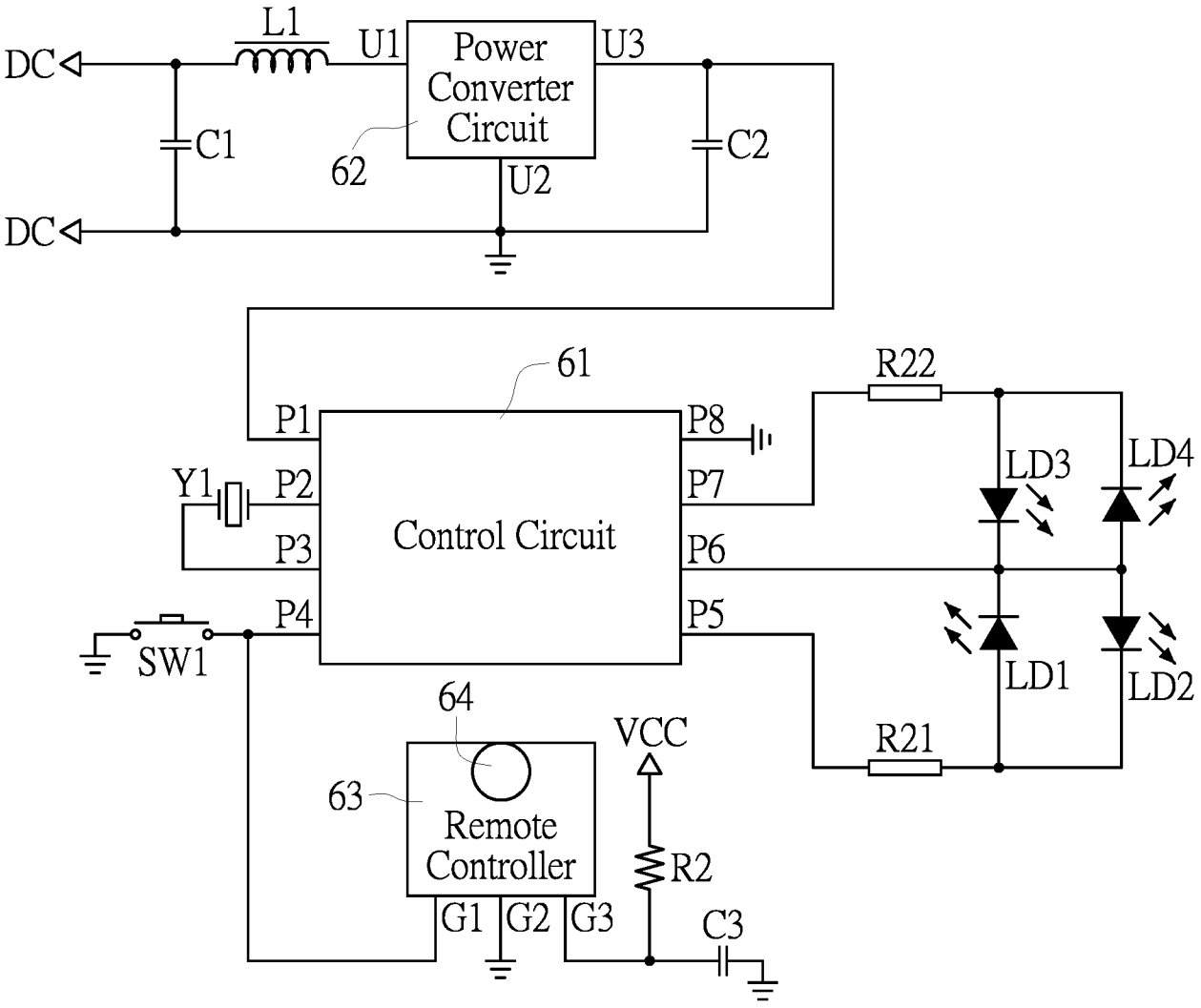
FIG. 7 is a circuit layout diagram of a light string controlling device capable of boosting power according to a fifth embodiment of the present disclosure.

Reference is made to FIG. 7, which is a circuit layout diagram of a light string controlling device capable of boosting power according to a fifth embodiment of the present disclosure. The same descriptions of the fifth and fourth embodiments are not repeated herein, but differences between them are described in the following.

The fifth pin P5 of the control circuit 61 may be connected to a first terminal of a second resistor R21. A second terminal of the second resistor R21 may be connected to the second terminal such as an anode terminal of the first light-emitting component LD1 and the second terminal such as a cathode terminal of the second light-emitting component LD2, through a first wire.

The sixth pin P6 of the control circuit 61 may be connected to the first terminal of such as a cathode terminal of the first light-emitting component LD1 and the first terminal such as an anode terminal of the second light-emitting component LD2, through a second wire.

A seventh pin P7 of the control circuit 61 may be connected to a first terminal of a third resistor R22. A second terminal of the third resistor R22 may be connected to a first terminal such as an anode terminal of a third light-emitting component LD3 and a first terminal such as a cathode terminal of a fourth light-emitting component LD4, through a third wire.

A second terminal such as a cathode terminal of the third light-emitting component LD3 and a second terminal such as an anode terminal of the fourth light-emitting component LD4 may be connected to the sixth pin P6 of the control circuit 61 through the second wire.

Sixth Embodiment

Figure 8:
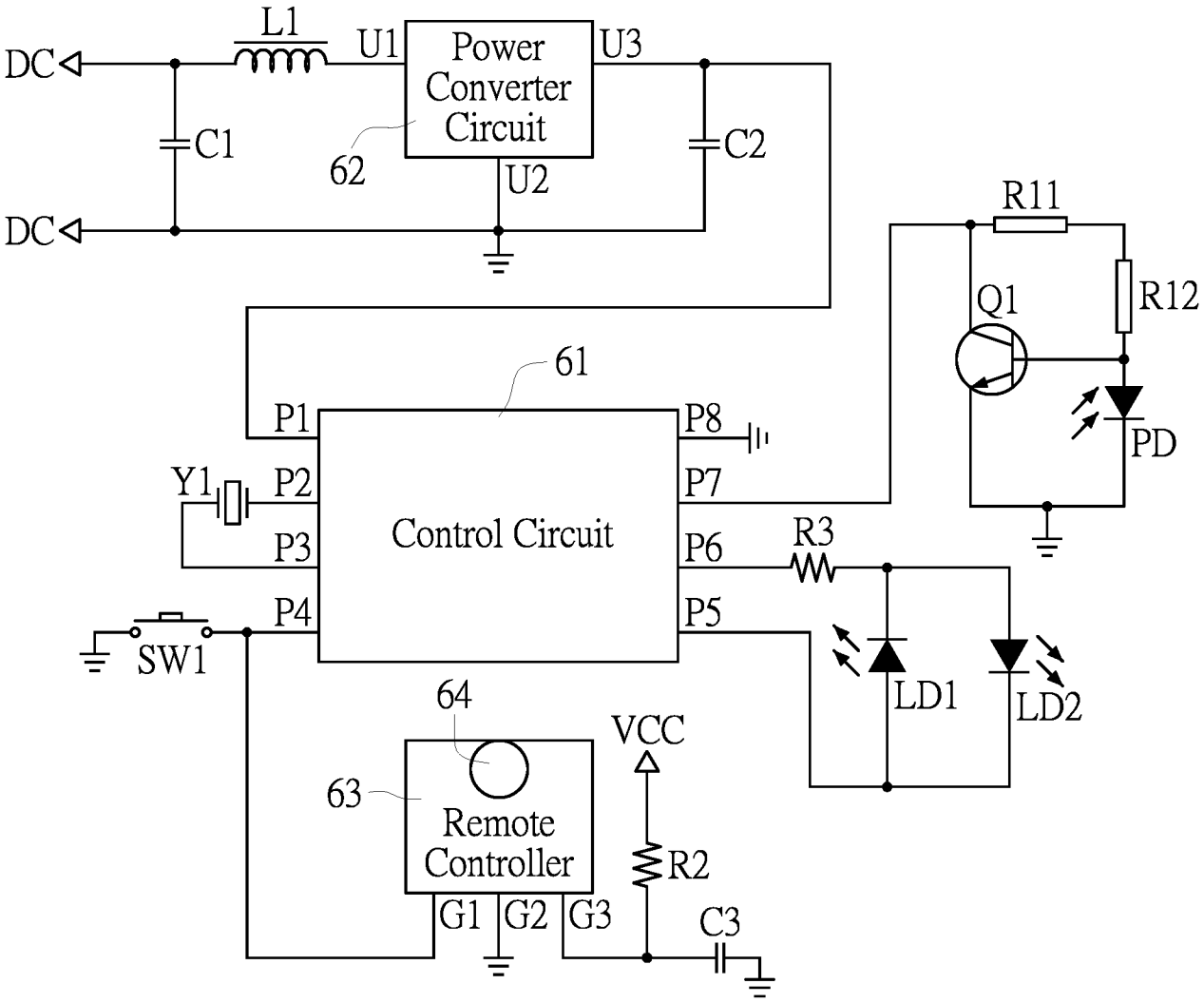
FIG. 8 is a circuit layout diagram of a light string controlling device capable of boosting power according to a sixth embodiment of the present disclosure.

Reference is made to FIG. 8, which is a circuit layout diagram of a light string controlling device capable of boosting power according to a sixth embodiment of the present disclosure. The same descriptions of the sixth and fifth embodiments are not repeated herein, but differences between them are described in the following.

The light string controlling device may include a light sensing component PD. For example, the light sensing component PD may be a photodiode.

The light sensing component PD may be directly connected to (the seventh pin P7 of) the control circuit 61, or connected to (the seventh pin P7 of) the control circuit 61 through other circuit components. For example, the other circuit components of the light string controlling device may include a second resistor R11, a third resistor R12 and a transistor Q1.

The seventh pin P7 of the control circuit 61 may be connected to a first terminal of the second resistor R11 and a first terminal of the transistor Q1. A second terminal of the second resistor R11 may be connected to a first terminal of the third resistor R12. A second terminal of the third resistor R12 may be connected to a first terminal such as an anode terminal of the light sensing component PD.

A control terminal of the transistor Q1 may be connected to the first terminal such as the anode terminal of the light sensing component PD. A second terminal of the transistor Q1 may be grounded. A second terminal such as a cathode of the light sensing component PD may be grounded.

The light sensing component PD may sense an intensity of an ambient light to output a light sensed signal to the control circuit of the control circuit 61. The control circuit 61 may control the light string to emit light according to the light sensed signal from the light sensing component PD.

In addition, the second terminal such as the anode terminal of the first light-emitting component LD1 and the second terminal such as the cathode terminal of the first light-emitting component LD2 may be connected to the fifth pin P5 of the control circuit 61, through a first wire.

The sixth pin P6 of the control circuit 61 may be connected to a first terminal of the fourth resistor R3. A second terminal of the fourth resistor R3 may be connected to the first terminal such as the cathode terminal of the first light-emitting component LD1 and the first terminal such as the anode terminal of the first light-emitting component LD2, through a second wire.

Seventh Embodiment

Figure 9:
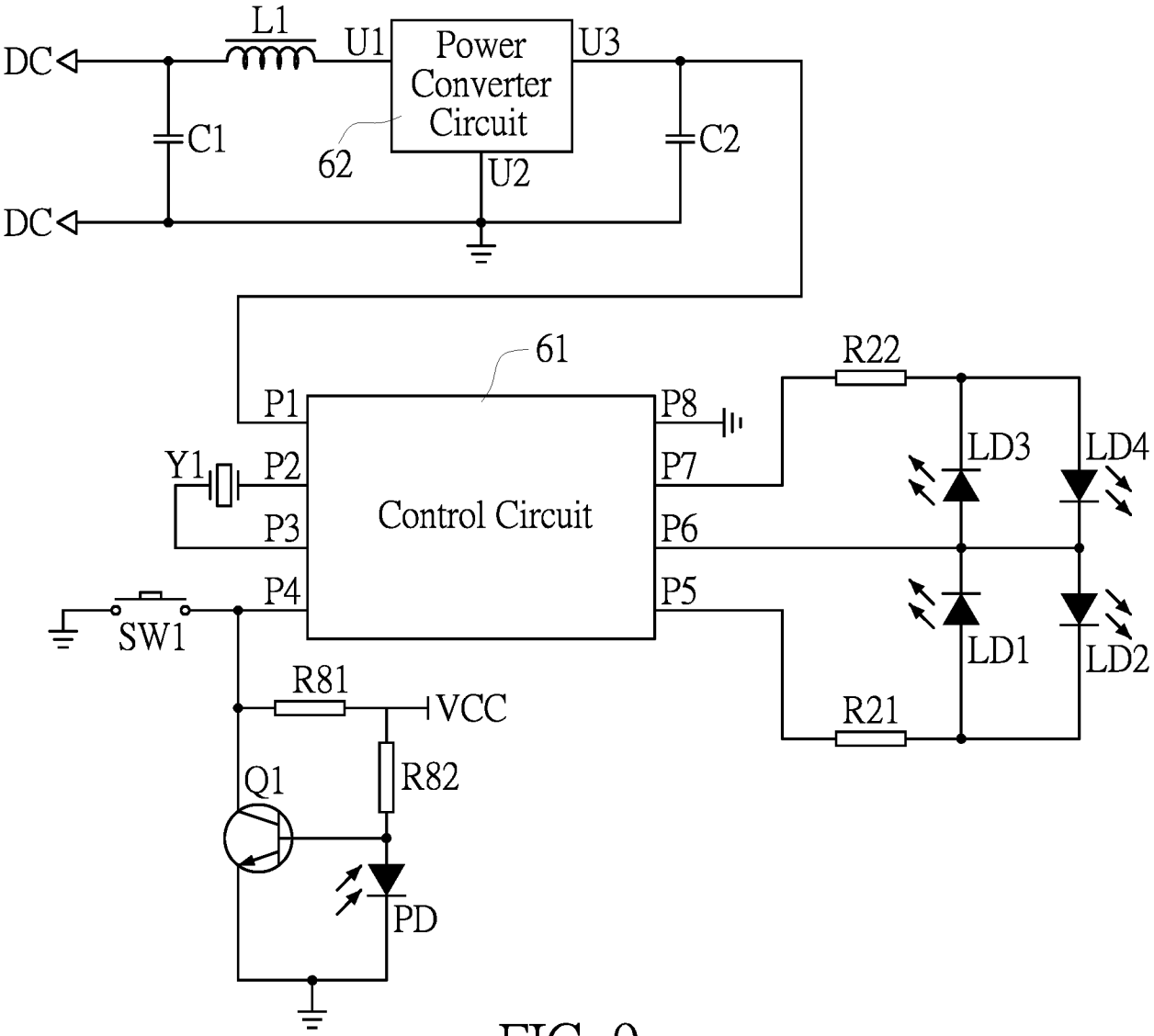
FIG. 9 is a circuit layout diagram of a light string controlling device capable of boosting power according to a seventh embodiment of the present disclosure.

Reference is made to FIG. 9, which is a circuit layout diagram of a light string controlling device capable of boosting power according to a seventh embodiment of the present disclosure.

The fifth pin P5 of the control circuit 61 may be connected to the first terminal of the second resistor R21. The second terminal of the second resistor R21 may be connected to the second terminal such as the anode terminal of the first light-emitting component LD1 and the second terminal such as the cathode terminal of the second light-emitting component LD2, through the first wire.

The sixth pin P6 of the control circuit 61 may be connected to the first terminal of such as the cathode terminal of the first light-emitting component LD1 and the first terminal such as the anode terminal of the second light-emitting component LD2, through the second wire.

The seventh pin P7 of the control circuit 61 may be connected to the first terminal of the third resistor R22. The second terminal of the third resistor R22 may be connected to the first terminal such as a cathode terminal of the third light-emitting component LD3 and the first terminal such as an anode terminal of the fourth light-emitting component LD4, through the third wire.

The second terminal such as an anode terminal of the third light-emitting component LD3 and the second terminal such as a cathode terminal of the fourth light-emitting component LD4 may be connected to the sixth pin P6 of the control circuit 61, through the second wire.

In addition, the fourth pin P4 of the control circuit 61 may be connected to a first terminal of a third resistor R81 and a first terminal of the transistor Q1. A second terminal of the transistor Q1 may be grounded. A second terminal of the third resistor R81 is coupled to the common voltage VCC and connected to a first terminal of a fourth resistor R82.

A second terminal of the fourth resistor R82 and a control terminal of the transistor Q1 are connected to a first terminal such as an anode terminal of a light sensing component PD. A second terminal such a cathode terminal of the light sensing component PD may be grounded.

Eighth Embodiment

Figure 10:
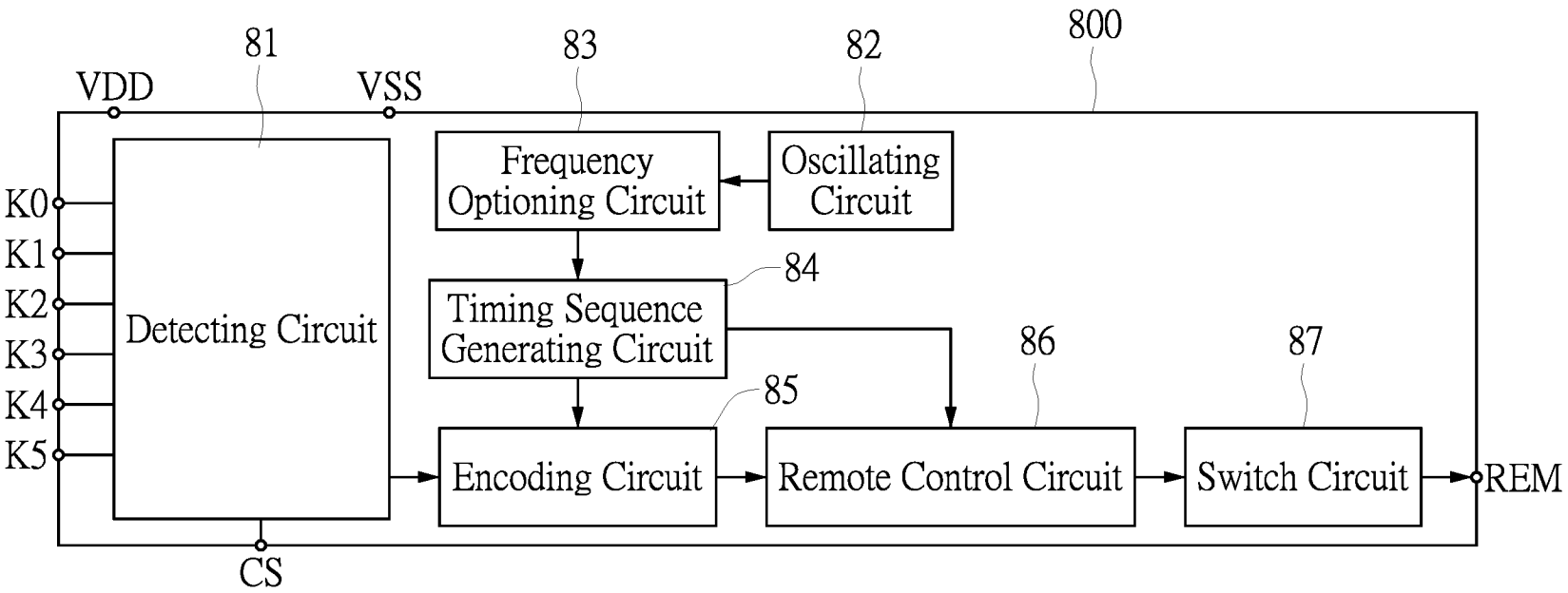
FIG. 10 is a block diagram of a light string controlling device capable of boosting power according to an eighth embodiment of the present disclosure.

Reference is made to FIG. 10, which is a block diagram of a light string controlling device capable of boosting power according to an eighth embodiment of the present disclosure.

The light string controlling device may include a remote controller 800. The remote controller 800 may include a detecting circuit 81, an oscillating circuit 82, a frequency optioning circuit 83, a timing sequence generating circuit 84, an encoding circuit 85, a remote control circuit 86 and a switch circuit 87.

The frequency optioning circuit 83 may be connected to the oscillating circuit 82 and the timing sequence generating circuit 84. The encoding circuit 85 may be connected to the detecting circuit 81 and the remote control circuit 86. The remote control circuit 86 may be connected to the switch circuit 87.

The oscillating circuit 82 may output one or more oscillating signals to the frequency optioning circuit 83. The frequency optioning circuit 83 may determine a frequency of the oscillating signal from the oscillating circuit 82 and accordingly output a frequency signal. The timing sequence generating circuit 84 may output a timing signal according to the frequency signal.

The detecting circuit 81 may be connected to a plurality of switch component respectively through a plurality of input terminals of the remote controller 800. When any one of the switch components is triggered such that the one of the switch components is electrically connected to the detecting circuit 81, the detecting circuit 81 outputs a detecting signal.

When the encoding circuit 85 receives the detecting signal, the encoding circuit 85 outputs an encoding signal according to the timing signal from the timing sequence generating circuit 84 and the detecting signal from the detecting circuit 81.

The remote control circuit 86 outputs the remote control signal to the switch circuit 87 that may include at least one transistor, according to the encoding signal from the encoding circuit 85 and the timing signal from the timing sequence generating circuit 84.

In summary, the present disclosure provides the light string controlling device capable of boosting power. When the number of the batteries placed into the control box is less than the number of the sub-accommodation spaces of the control box such that the batteries supply insufficient power, the control circuit can control the power convertor circuit such as the boost converter circuit to boost the power and supply the boosted power to the light string. Therefore, only fewer batteries need to be used, thereby saving source and costs, and reducing damage to the environment caused by the batteries.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A light string controlling device capable of boosting power, comprising:

a control box having a first accommodation space and a second accommodation space;

a power supply circuit accommodated in the first accommodation space of the control box and configured to supply power;

a power converter circuit accommodated in the second accommodation space of the control box, and connected to the power supply circuit, wherein the power converter circuit converts the power from the power supply circuit and outputs the power that is converted;

a control circuit accommodated in the second accommodation space of the control box, and connected to the power converter circuit and a light string, wherein the control circuit controls the power converter circuit to convert the power according to an amount of power required for the light string to produce a desired lighting effect and transmits the power from the power converter circuit to the light string, and the control circuit controls the light string to produce the desired lighting effect; and a remote controller disposed outside the control box and connected to the control circuit, and configured to output a remote control signal to the control circuit to control the control circuit.

2. The light string controlling device according to claim 1, wherein the power converter circuit includes a boost converter circuit configured to boost the power from the power supply circuit.

3. The light string controlling device according to claim 1, wherein the power supply circuit includes a battery accommodated in the first accommodation space of the control box;

wherein, when the control circuit determines that an amount of the power supplied by the battery is smaller than the amount of power required for the light string to produce the desired lighting effect, the control circuit calculates a difference between the amount of the power supplied by the battery and the amount of power required for the light string, and the control circuit controls the power converter circuit to boost the power supplied by the battery according to the difference.

4. The light string controlling device according to claim 1, wherein the power supply circuit includes a plurality of batteries accommodated in the first accommodation space of the control box;

wherein, when the control circuit determines that a total amount of the power supplied by the plurality of batteries is smaller than the amount of power required for the light string to produce the desired lighting effect, the control circuit calculates a difference between the total amount of the power supplied by the plurality of batteries and the amount of power required for the light string, and the control circuit controls the power converter circuit to boost the power supplied by one or more of the plurality of batteries according to the difference.

5. The light string controlling device according to claim 1, further comprising:

a mode switch component disposed on the control box and disposed adjacent to the control circuit;

wherein, when each time the mode switch component is triggered, the control circuit counts a number of times that the mode switch component is triggered, the control circuit controls the light string to enter one of a plurality of lighting modes according to the number of times that the mode switch component is triggered, and the light string exhibits a plurality of lighting states respectively in the plurality of lighting modes.

6. The light string controlling device according to claim 1, further comprising:

a light sensing component connected to the control circuit and configured to sense an intensity of ambient light to output a light sensed signal to the control circuit, and the control circuit controls the light string according to the light sensed signal.

7. The light string controlling device according to claim 1, further comprising:

a power-on switch component disposed on the remote controller; and a power-off switch component disposed on the remote controller;

wherein, when the power-on switch component is turned on, the remote controller controls the control circuit to transmit the power from the power converter circuit to the light string;

wherein, when the power-off switch component is turned on, the remote controller does not control the control circuit to transmit the power from the power converter circuit to the light string.

8. The light string controlling device according to claim 1, further comprising:

a plurality of time switch components disposed on the remote controller;

wherein, when the plurality of the time switch components are respectively turned on, the remote controller instructs the control circuit to control the light string to emit the light respectively within a plurality of preset times.

9. The light string controlling device according to claim 1, further comprising:

a lighting mode switch component disposed on the remote controller;

wherein, when each time the mode switch component is triggered, the remote controller controls counts a number of times that the mode switch component is triggered, the remote controller controls the light string to enter one of a plurality of lighting modes according to the number of times that the mode switch component is triggered, and the light string exhibits a plurality of lighting states respectively in the plurality of lighting modes.

10. The light string controlling device according to claim 1, further comprising:

a color changing switch component disposed on the remote controller;

wherein, when the color changing switch component is triggered, the remote controller controls the light string to change a color of the light emitted by the light string, and the color of the light emitted by the light string depends on a number of times that the color changing switch component is triggered.

11. The light string controlling device according to claim 1, further comprising:

a brightness increasing component disposed on the remote controller; and a brightness decreasing component disposed on the remote controller;

wherein, when each time the brightness increasing component is triggered, the remote controller instructs the control circuit to increase the power supplied to the light string;

wherein, when each time the brightness decreasing component is triggered, the remote controller controls the control circuit to decrease the power supplied to the light string.

* * * * *